United States Patent [19]

Trumbull

[11] 4,066,256

[45] Jan. 3, 1978

[54] AMUSEMENT RIDE

[75] Inventor: Douglas Trumbull, Santa Monica, Calif.

[73] Assignees: Future General Corporation; Standard Alliance Industries Inc., both of Los Angeles, Calif.

[21] Appl. No.: 632,222

[22] Filed: Nov. 17, 1975

[51] Int. Cl.[2] ..... A63G 31/16; G09B 9/00

[52] U.S. Cl. ..... 272/18; 35/12 N; 35/12 P

[58] Field of Search ..... 272/18, 17, 16; 35/11 R, 12 P, 12 N, 12 W, 12 R; 352/85, 239, 240, 131, 132, 40

[56] References Cited

U.S. PATENT DOCUMENTS

| | | | |
|---|---|---|---|
| 800,297 | 9/1905 | Havenstrite | 272/18 |
| 892,070 | 6/1908 | Murphy | 272/17 X |
| 1,789,680 | 1/1931 | Gwinnett | 272/18 |
| 2,861,806 | 11/1958 | Disney | 272/18 |
| 3,628,829 | 12/1971 | Heilig | 272/16 UX |
| 3,645,011 | 2/1972 | Callanen | 35/12 P |
| 3,967,387 | 7/1976 | Marchegiani | 35/12 P |

FOREIGN PATENT DOCUMENTS

| | | | |
|---|---|---|---|
| 543,688 | 6/1922 | France | 272/18 |
| 1,273,969 | 9/1961 | France | 272/18 |
| 425,723 | 10/1947 | Italy | 272/18 |

OTHER PUBLICATIONS

A Platform with Six Degrees of Freedom by D. Stewart Proc. Instn. Mech. Engrs., 1965-1966, vol. 180, Pt. 1, No. 15, pp. 371-386.

*Primary Examiner*—William H. Grieb
*Assistant Examiner*—Arnold W. Kramer
*Attorney, Agent, or Firm*—Lindenberg, Freilich, Wasserman, Rosen & Fernandez

[57] ABSTRACT

A relatively inexpensive and compact ride for an amusement park and the like, which creates the illusion that the passengers are seated in a rapidly maneuvering vehicle, by applying forces to the passenger in synchronism with the display of a motion picture image. The apparatus includes a passenger-holding frame which has three locations resting on hydraulic rams that can tilt the frame or move it up and down, and a film projector and viewing screen connected to the frame to move with it. When the motion picture simulates the view from a vehicle that is turning to the right, the rams are operated to tilt the vehicle to the left, to simulate the centrifugal forces that would result from a vehicle turning to the right. When the motion picture indicates forward acceleration, the vehicle is tipped backwardly. When the motion picture indicates vertical acceleration, the rams are rapidly moved up or down.

2 Claims, 10 Drawing Figures

Fig. 3
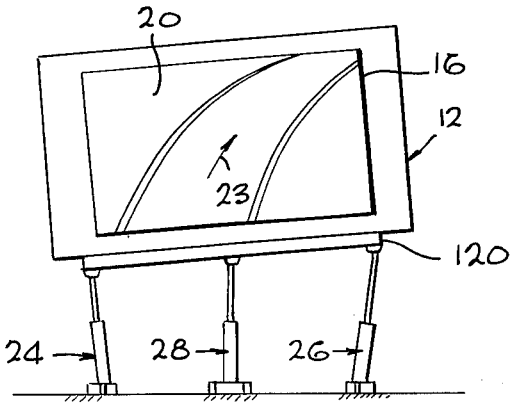
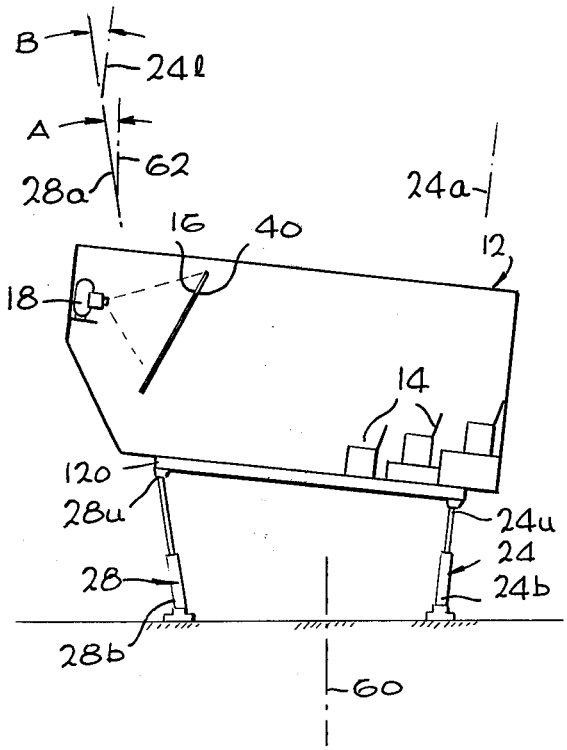
Fig. 4
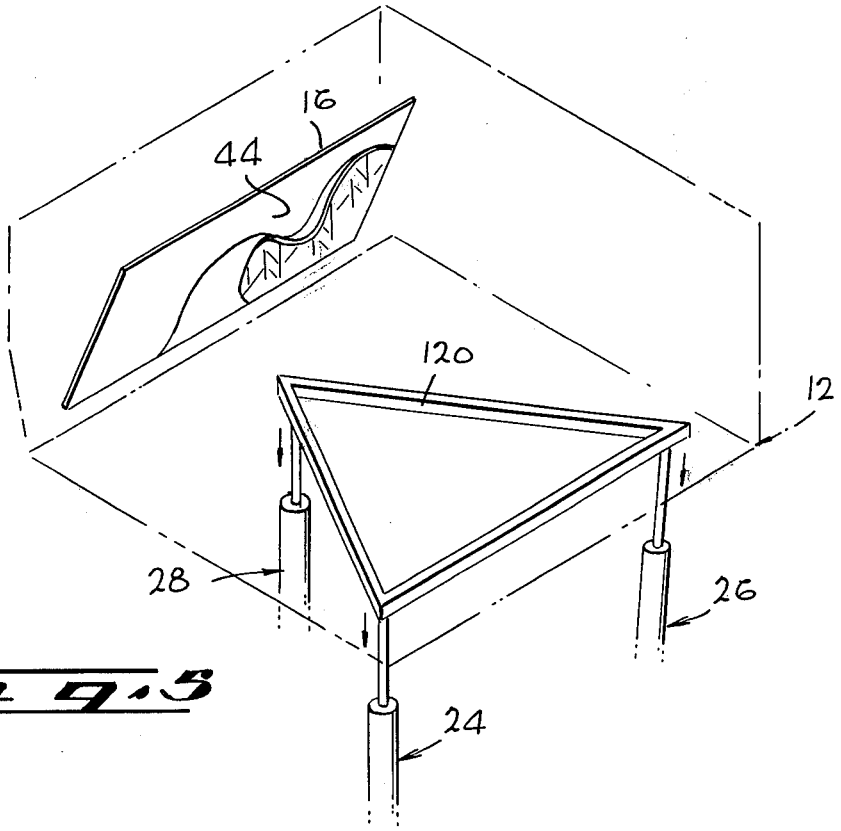
Fig. 5

Fig. 9
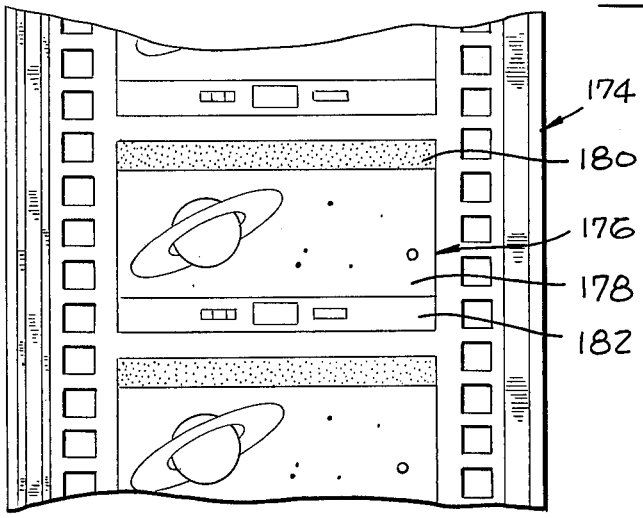
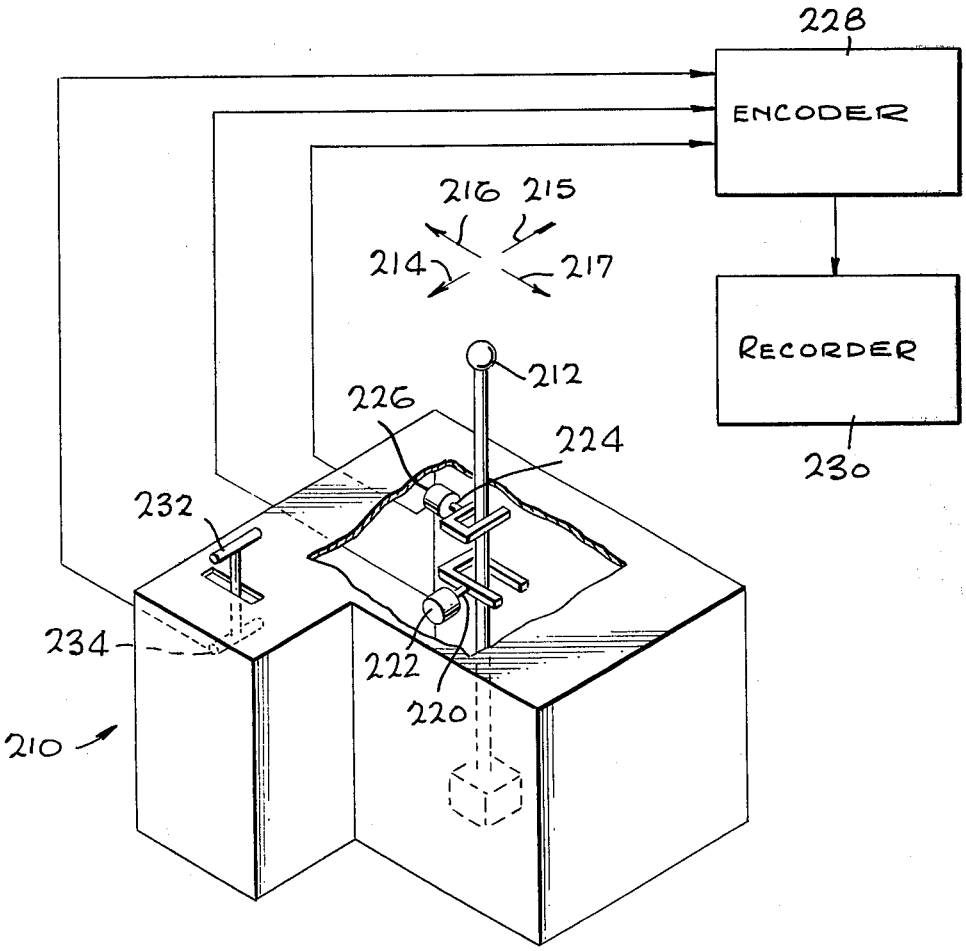
Fig. 10

AMUSEMENT RIDE

BACKGROUND OF THE INVENTION

This invention relates to an amusement ride for use in an amusement park or the like to entertain people.

Amusement rides such as roller coasters, which provide forces to the entire human body during rapid vehicle motion, are often considered among the most entertaining rides. The entertainment could be enhanced by providing images that simulate the view from a rapidly moving vehicle, such as a maneuvering airplane, and synchronizing the view with the forces applied to the passengers. Such a ride could be made highly entertaining, but in order to gain wide acceptance, the structure must be made relatively compact and inexpensive. Flight simulators create somewhat the same illusion. However, the need for accuracy in orientation of the pilot of a flight simulator, and the need to accurately vary the viewed image in accordance with the pilot's response, results in such simulators being complex and expensive and often providing very limited force simulation.

SUMMARY OF THE INVENTION

In accordance with one embodiment of the present invention, a relatively inexpensive amusement ride is provided which simulates movement in a rapidly moving and maneuvering vehicle. The ride apparatus includes a passenger-holding frame, image means for forming a motion picture image that is viewed by persons in the frame as though it were the view from a vehicle, and a drive for tilting the vehicle in synchronism with the motion picture. When the motion picture depicts turning to the right of a rapidly moving vehicle, the drive tilts the vehicle to the left, so that the passengers experience a sideward force corresponding to the centrifugal force that would be experienced by passengers in an actual vehicle that was turning to the right. Of course, during turning to the left, the drive tilts the passenger frame to the right. When the motion picture simulates rapid forward acceleration or deceleration, the drive tilts the vehicle respectively rearwardly or forwardly. The drive can be constructed to also simulate vertical acceleration or deceleration by rapidly moving the passenger frame up or down. The apparatus for displaying the motion picture is made to move with the passenger frame during tilting or other movement.

One drive for moving the passenger-holding frame includes three hydraulic rams spaced about the frame, with one ram at the middle of the forward portion of the frame, and with the other two rams at opposite sides of the rearward portion of the frame. Tilting to the left or right is accomplished by raising one rearward ram while lowering the other rearward ram. Tilting forward or rearward is accomplished by raising or lowering the forward ram and/or lowering or raising the rearward rams. Vertical acceleration is accomplished by raising or lowering all rams.

The novel features of the invention are set forth with particularity in the appended claims. The invention will best be understood from the following description when read in conjunction with the accompanying drawings.

DESCRIPTION OF THE DRAWINGS

FIG. 3 is a sectional rear view of the ride of FIG. 1, showing the manner in which vehicle motion in a turn is simulated;

FIG. 4 is a sectional side view of the ride of FIG. 1, showing the manner in which forward acceleration is simulated;

FIG. 5 is a partial perspective view of the ride of FIG. 1, showing how downward vertical acceleration is simulated;

FIG. 9 is a front elevation view of a portion of a film of the apparatus of FIG. 8; and FIG. 10 is a perspective view of a motion recording system constructed in accordance with another embodiment of the invention.

DESCRIPTION OF THE PREFERRED EMBODIMENTS

Figure 1:
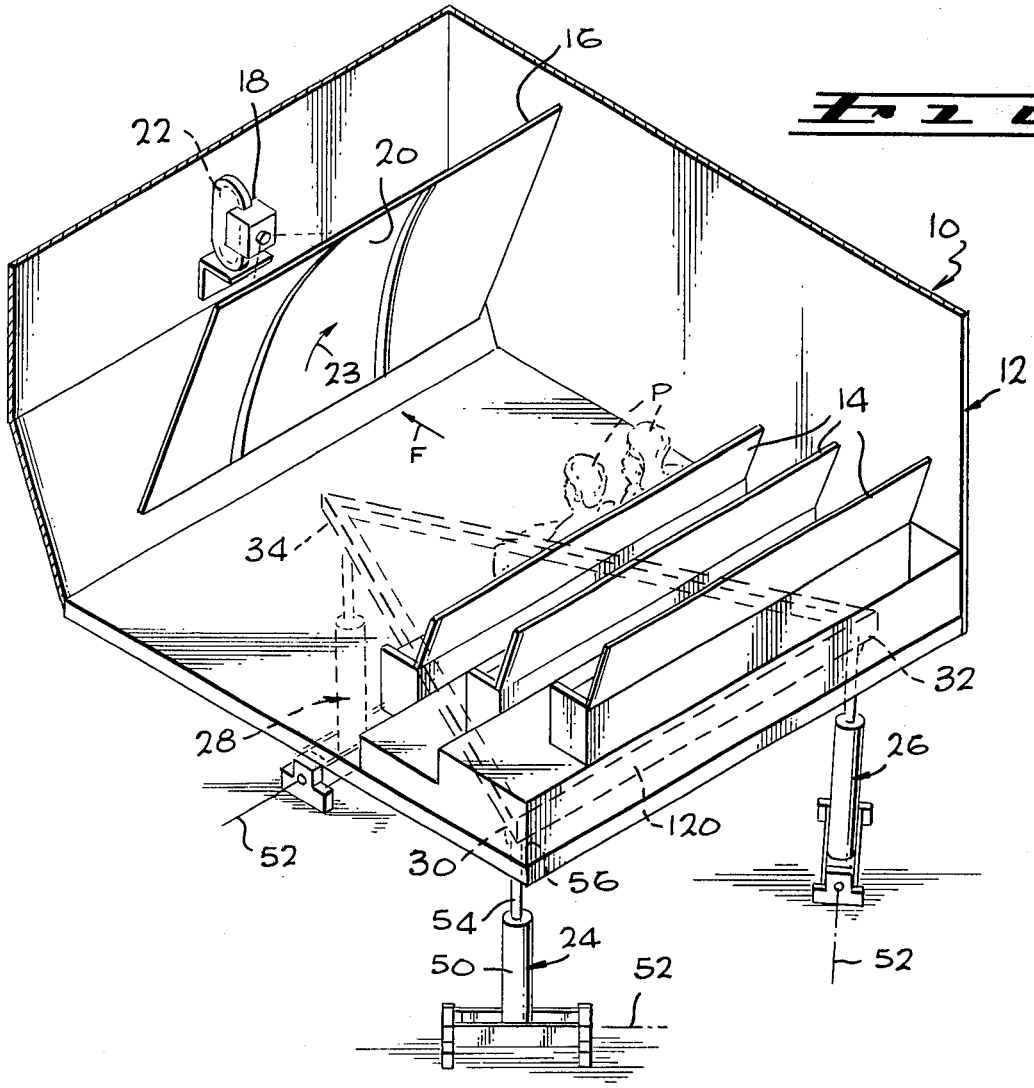
FIG. 1 is a sectional perspective view of an amusement ride constructed in accordance with one embodiment of the present invention.

FIG. 1 illustrates an amusement ride apparatus 10 which includes a passenger-holding frame 12 with several seats 14 for seating passengers that will be facing in a forward direction, as indicated by arrow F. A rear projection screen 16 lies in front of the passengers, and a motion picture projector 18 is provided to project a motion picture image 20 on the screen. The particular reel of film or record 22 which is being used in the projector, contains scenes representing the view from a rapidly moving vehicle, with the particular image shown at 20 representing the view seen from a race car which is travelling on a road that curves to the right as indicated by arrow 23. In order to enhance the entertainment effect, the passenger-holding frame 12 is supported on three hydraulic rams 24, 26, 28 that support three locations 30, 32, 34 spaced about the passenger frame. The rams can tip the frame, either to one side or to the front or back, and can also rapidly raise and lower the frame. This movement produces forces on the passengers that correspond to the forces that would be experienced if the passengers were in an actual vehicle executing the maneuvers indicated by the motion picture image 20 on the screen.

The entertainment obtained in viewing the motion picture image 20 of FIGS. 1 and 3, which represent a racing automobile traversing a track that is curved to the right, is enhanced by tipping the passenger-holding frame 12 to the left. The resulting sideward force component on the passengers, corresponds to the leftward centrifugal forces that would be experienced by passengers in an actual automobile that was traversing a track that curved to the right. Accordingly, the passengers experience largely the same forces that would be felt in the actual experience depicted on the screen resulting in greatly enhanced entertainment. The screen 16 projector 18 are mounted on the frame 12, to tip in the same direction and to the same degree as the passengers, so that the passengers do not sense that they are tipping but merely feel the equivalent of centrifugal forces. The room formed by the passenger-holding frame 12 has no openings for the passengers to look out of, and therefore the passengers do not visually sense that the frame that is tipping. Of course, when the motion picture image indicates a turn to the left, the frame 12 is tipped to the right.

FIG. 4 illustrates another orientation of the frame 12, to simulate forward acceleration of a vehicle. To achieve this, the frame 12 is tilted backward while a motion picture image 40 is projected that represents the view from a forwardly accelerating vehicle. Of course, the forces experienced during deceleration of a vehicle can be simulated by tipping the passenger frame forwardly.

FIG. 5 illustrates the apparatus with an image 44 on the screen that represents the view from a roller coaster car during movement down a steep incline. Downward acceleration is actually imparted to the frame 12, by rapidly lowering all of the hydraulic rams 24, 26, 28. In the case of movement down an incline portion of a roller coaster track, a forward tilt of the frame is also utilized. It may be noted that in the case of downward or upward acceleration, the frame 12 is actually accelerated up or down. However, the acceleration of the frame 12 is perforemd over a relatively short distance of several feet and the frame may then stop, instead of continuing to move as would often occur in a real vehicle undergoing acceleration.

Each of the hydraulic rams such as 24, includes a cylinder 50 which is pivotally mounted on the ground about a horizontal axis 52. The ram also includes a piston 54 whose lower end slides within the cylinder, and whose upper end is connected by a universal joint 56 to a location 30 on the passenger-holding frame 12. Actually, it is only necessary that the joint 56 allow pivoting of the piston 54 with respect to the frame about two horizontal axes. Of course, a variety of drives can be utilized, such as pneumatic cylinders, or electric motors that can turn screws. However, as hydraulic ram is generally the most compact unit for providing large controlled forces for brief periods of time. Such forces are required during rapid lifting of the passenger-holding frame, with much less power being required during most of the other maneuvers. It should be understood that a variety of hydraulic ram devices are available that can be utilized.

Each of the hydraulic rams is oriented primarily in a vertical direction, but with the axis such as **28*a* at a small angle A (FIG. 4) from the vertical 62. The purpose of such angling is to always provide a small horizontal force in a constant direction to each ram to avoid sideward rattling. In the apparatus of FIGS. 1 — 5, all of the rams are angled outwardly, so that their upper ends such as 24*u* are further from the other rams and from the central axis 60 of the frame than their bottom ends 24*b*. This conserves a small amount of space at the bottom of the apparatus, as compared to a situation wherein all of the rams were angled inwardly. The angle A between the axis of each ram such as axis 28*a* and a vertical line 62 is approximately 10°. Since all of the rams are angled outwardly from the center 60, the angle B between the axis 28*a* of one ram 28 and a line 24*l* parallel to the axis 24*a*** of another ram, is almost twice the angle A.

Figure 2:
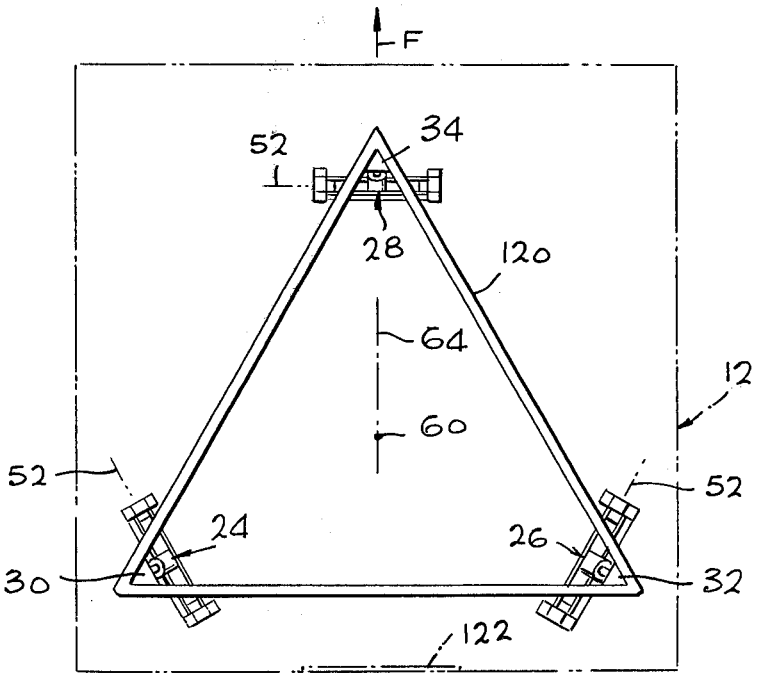
FIG. 2 is a partial plan view of the ride of FIG. 1.

As seen in the plan view of FIG. 2, the rams 24 - 18 are arranged with one ram 28 at the forward portion of the passenger-holding frame 12 and located along a longitudinal center line 64 which lies halfway between opposite sides **12*m*, 12*n* of the frame. The other two rams 24, 26 lie near the rearward end of the frame and near opposite sides thereof, with each ram 24, 26 being spaced equally from the longitudinal center line 64. When the frame 12 is fully loaded with passengers, the rearward end is heavier than the forward end, and the two rearward rams 24, 26 help to support and move the weight. This arrangement of the rams also simplifies programming the motion of the frame. When the frame 12 tips to one side as in FIG. 3, one of the rams 24 near one side of the vehicle is lowered, while the ram 26 on the other side is raised by an equal amount; the forward ram 28 does not move up or down. When the frame tips rearwardly, as shown in FIG. 4, one of the rams 28 moves up while the other two rams 24, 26** remain stationary or move downward in synchronism.

Figure 6:
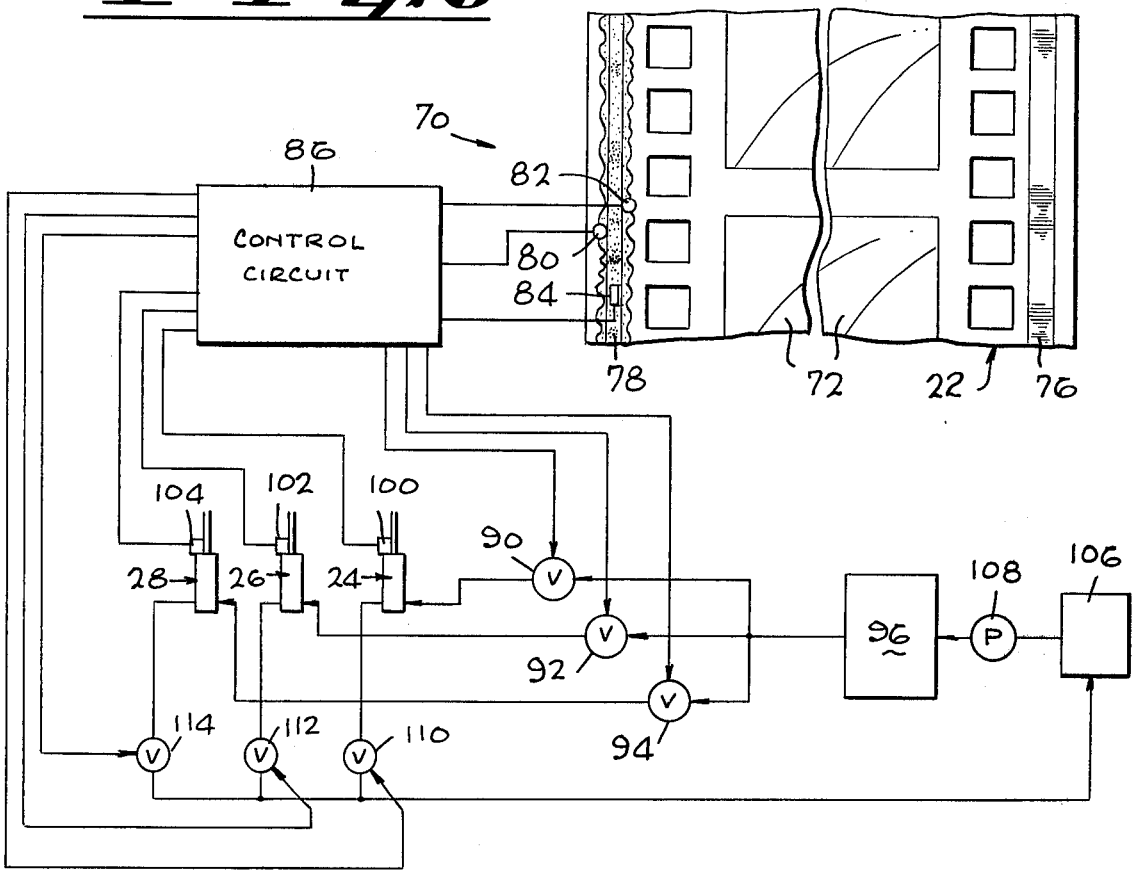
FIG. 6 is a partial circuit diagram of the controlling circuitry of the ride of FIG. 1.

FIG. 6 illustrates a portion of the control system which controls movement of the three rams 24 - 28. The motion picture image is created by an image portion 72 of a film 22 that is contained in the projector. The film includes a sound track 76 along one edge and a motion control track 78 along the opposite edge. Three sensors 80, 82, and 84 respectively sense opposite edges of the track and the density along the center of the track, and deliver corresponding signals to a control circuit 86. Each of the sensors 80 - 84 detects signals representing the position of a different one of the three rams 24 - 28. The control circuit 86 delivers signals corresponding to those detected by the sensors 80 - 84 to three valves 90, 92, 94 that control the passage of pressured oil from an accumulator 96 to the three rams 24 - 28. Three ram position sensors 100, 102, 104 are also provided, each sensing the height of a corresponding one of the rams, and with each position sensor being coupled to the control circuit 86. Thus, a feedback circuit is provided to enable close control of the position of each ram. Each of the rams has a fluid outlet connected through a corresponding valve 110, 112, 114 which leads to a reservoir 106 that stores hydraulic fluid. A pump 108 pumps fluid from the reservoir to the accumulator 96 to maintain a high pressure in the accumulator, so that pressured hydraulic fluid is always available. Each of the outlet valves 110, 112, 114 is electrically energized from the control circuit 86.

Each of the inlet valves 90–94 is constructed so that it remains closed when no current is applied to it, and so that it can be opened only upon the application of current. On the other hand, each outlet valve such as 110 is constructed so that it remains open when no current is applied to it, and can be closed only upon the application of current thereto. As a result, in the event of electrical failure of the system wherein no current is produced by the control circuit 86, the inlet valves 90–94 will be closed while the outlet valves 110–114 will be open. This results in all hydraulic rams 24–28 losing oil so that their pistons move down to the lowest possible elevation. This facilitates the exit of passengers in case of failure, by lowering the frame to a level orientation and at the lowest elevation. If such a system were not utilized and failure occurred while the vehicle was tilted or raised, there could be danger not only in attempting to remove passengers from an elevated and tilted floor, but also there could be danger to workmen helping in the removal of passengers if the frame suddenly descended.

The passenger holding frame 12 may be constructed, as illustrated in FIGS. 1 and 2, with a triangular support 120 which couples the rams to the rest of the frame. A rear door 122 provides an opening for entrance and exit of the passengers. A ramp or stairway can be provided which leads up to the level of the frame at its lowered position, or the bottoms of the rams 24–28 can be located below ground level.

Figure 7:
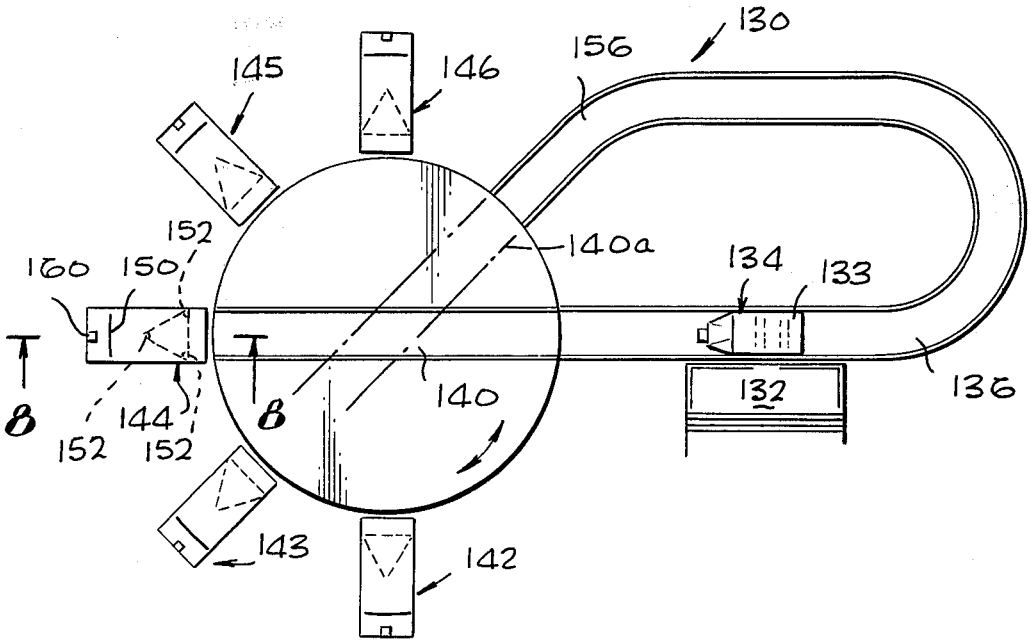
FIG. 7 is a perspective view of a ride apparatus constructed in accordance with another embodiment of the invention.
Figure 8:
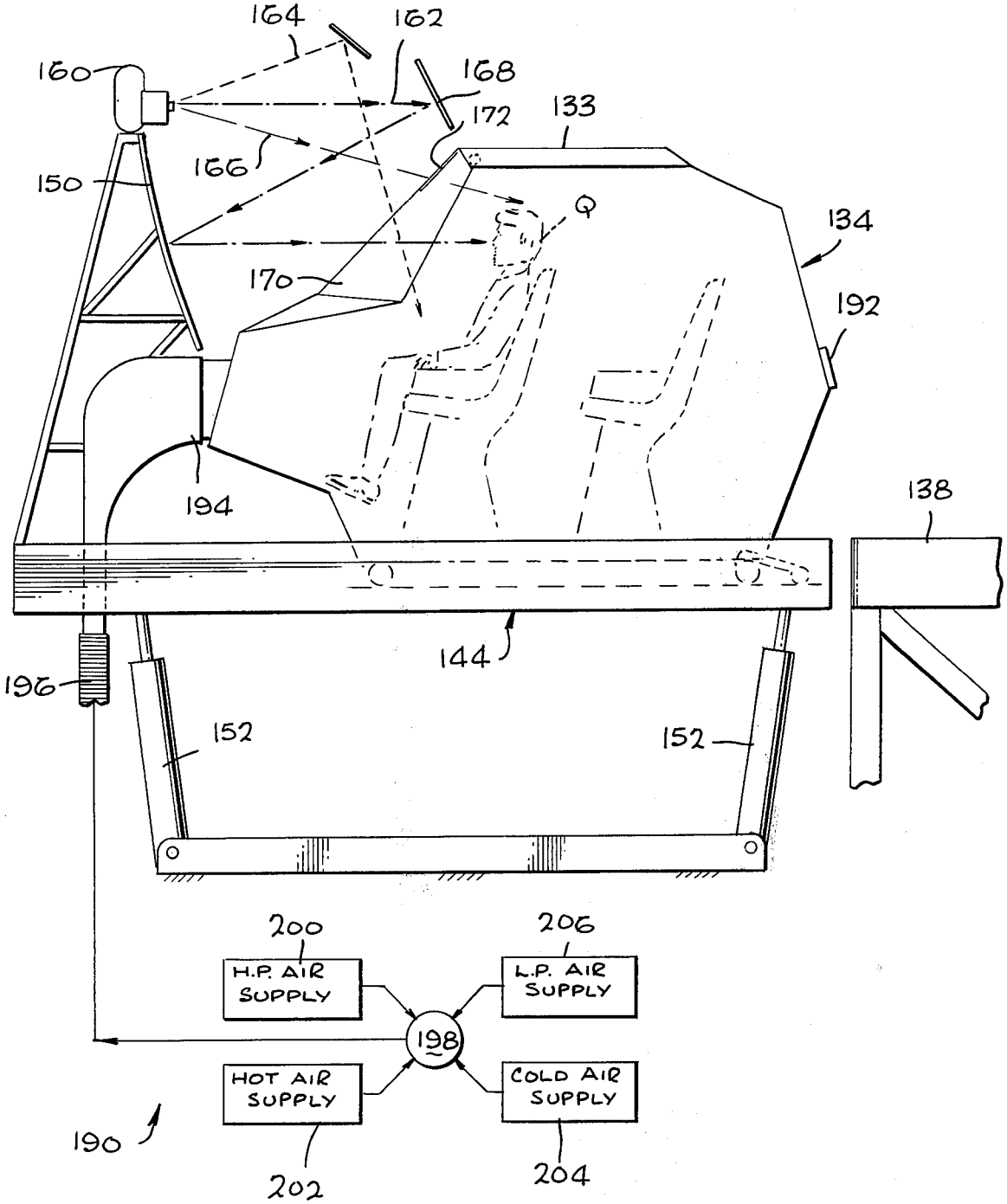
FIG. 8 is a sectional side elevation view taken on the line 8–8 of FIG. 7.

FIGS. 7–9 illustrate an amusement ride apparatus 130 which is designed for use by large numbers of passengers, as at an amusement park. The apparatus includes a passenger loading station 132 where passengers wait to enter a passenger-holding frame 134. The frame 134, which has an upwardly pivotal door 135, moves along a track 136 from the passenger loading station 132 to a turntable 138 that carries a track section 140. A passenger-holding frame, such as 134, on the turntable 138 can move onto any one of several frame-receiving structures 142–146. At each frame-receiving structure such as 144, the passenger-holding frame 134 is received behind a screen 150 on which a motion picture image can be projected. Each receiving structure is supported on the ground by three hydraulic rams 152, which operate in a manner similar to those of FIG. 1. The rams 152 enable tilting of the receiving structure 144, with the screen 150 and passenger-holding frame 134 thereon, to tilt them and move them up and down, in the same manner as the apparatus of FIG. 1. At the end of each showing of the motion picture image, the frame 134 is backed off of the frame-receiving structure such as 144 onto the turntable 138. The turntable is then rotated so that its track is moved to the position **140*a* wherein it is aligned with an exit track portion 156. The frame 134 is then moved onto the exit track portion, into a loop, and back to a position adjacent to the passenger loading station 132. The entire apparatus includes additional passenger-holding frames similar to 134**.

As shown in FIG. 8, the imaging system is constructed so that the projector 160 projects three separate light bundles 162, 164, and 166. One of the light bundles 162, which represents the motion picture image, is projected at a mirror 168 which reflects the light onto the screen 150. A passenger Q in the passenger-holding frame 134, can view the screen through a windshield 170 of the frame. A second light bundle 164 represents lighting effects, such as flashes of light that illuminate the passenger-holding frame without appearing on the screen 150, to create a more realistic effect. A third light bundle 166 represents displays on an instrument panel, and is projected onto a rear projection screen 172 that represents an instrument panel location. The light bundle 166 can represent instrument dials and flashing spots of light that one might expect to see on the instrument panel of a sophisticated vehicle.

A portion of a film which creates the light bundles, is illustrated at 174 in FIG. 9. Each film frame such as 176 of the film, includes a large motion picture image portion 178 that represents the view seen through the windshield, and that modulates or controls the light bundle 162 that is projected onto the screen 150. Another portion 180 of the frame normally includes a strip of a desired color, and controls the light bundle 164 that produces lighting effects in the passenger-holding frame from a direction other than the screen 150 that holds the motion picture image. Another portion 182 of the film frame includes images representing those on an instrument panel, and controls the light beam 166 that forms the image on the instrument panel screen 172. Thus, in addition to the motion picture image, lighting effects and an instrument panel display are provided which are synchronized with the motion picture image, to add to the realism of the ride.

The ride apparatus shown in FIG. 8 also includes apparatus 190 for moving air into the passenger-holding frame. The frame 190 has an outlet 192 and has an inlet 94 coupled to an air conduit 196 on the frame receiving structure. The air conduit 196 can be coupled through a valve 198 to a high pressured room temperature air supply 200, to a pressured hot air supply 202, to a pressured cold air supply 204, or to a low pressure room-temperature air supply 206. Normally, the conduit 196 is coupled to air supply 206 to provide ventilation that is unnoticed by the passengers. When the conduit is coupled to the high pressure supply 200, a wind effect is created which can enhance the realism of the ride. When the conduit is coupled to the hot or cold air supplies 202 or 204, the feeling of passing through a hot environment such as in a spacecraft near the sun, or through a cold environment such as near the North Pole, can be enhanced.

FIG. 10 illustrates a programming device 210 for recording signals that can control the rams of FIGS. 1 or 8. The device includes a joystick control 212 that can be moved laterally, as indicated by arrows 214, 215, or longitudinally, as indicated by arrows 216, 217. Lateral movement of the joystick causes movement of a wiper 220 to change the resistance of a linear potentiometer 222. Longitudinal movement of the joystick causes movement of another wiper 224 to change the resistance of another potentiometer 226.

The resistance of the lateral potentiometer 222 can conrol the two rearward rams, such as 24 and 26 of FIG. 1, to tilt the passenger frame sidewardly in proportion to lateral movement of the joystick from a central position. Similarly, the resistance of the lateral potentiometer 226 can tilt the forward ram 28 with respect to the rearward rams 24, 26, to create a forward or rearward tilt in proportion to longitudinal movement of the joystick from a central position. The two potentiometers are coupled to an encoding circuit 228 which transmits signals to a tape recorder 230.

In addition to the joystick, the programming device includes an up-down lever control 232 that can move all rams, such as 24, 26, 28 up or down to create vertical movement. A potentiometer 234 coupled to the lever control 232 is also connected to the encoder 228 which delivers corresponding signals to the tape recorder 230.

In the production of a complete film or other record, the motion picture image may be first created. A producer can then sit in the passenger frame, such as 12 of FIG. 1, while the programming device 210 is at his side. The producer then views the motion picture image, while operating the joystick 212 and lever control 232. The potentiometers 220, 222 and 234 can be connected to the control circuit 86 (FIG. 6) so that the passenger-holding frame moves in response to the operation of the programming device. The potentiometers are also connected to the encoder 228 that is connected to the tape recorder 230. Thereafter, the record on tape of the tape recorder can be transferred to track 78 on the film. Signals that control the ram can be recorded in a variety of ways, such as on a magnetic track on the image-creating film, or on a tape which is separate from the film or from an image-creating videotape, but which is synchronized with it.

Thus, the invention provides an entertaining ride that is relatively simple and inexpensive. This is accomplished by a film projector, television apparatus or other means for creating a motion picture image, with at least some segments of the image representing the view from a vehicle that is undergoing maneuvers that would produce forces on the bodies of passengers in the vehicle.

The apparatus also includes drive means such as hydraulic rams, for producing limited movement of the passenger-holding frame to create forces on the bodies of the passengers corresponding to those which would be experienced in an actual vehicle undergoing maneuvers. In order to simplify the moving apparatus, centrifugal forces occurring during turning to the right or left, is simulated by tipping the vehicle respectively to the left or right. The forces resulting from forward or rearward acceleration, are simulated by tipping the vehicle respectively rearwardly or forwardly. The forces resulting from vertical acceleration are produced by actual vertical acceleration of the frame, though over a limited distance. This relatively simple manner of simulating forces is possible because the apparatus is strictly an entertainment ride, and because it therefore does not matter that the orientation of the frame is different than would be experienced in an actual vehicle. The change in vehicle orientation or position is accomplished by only a limited number of substantially vertical drives, such as three hydraulic rams that are coupled to three locations spaced about the passenger-holding frame.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. An amusement ride apparatus, comprising:

a passenger-holding frame;

image means including screen means viewable by passengers in said frame, and means forming a predetermined motion picture image viewable by looking at said screen means and representing the veiw from a moving vehicle; and drive means for selectively moving each of a plurality of spaced locations on said frame vertically to change the position of said passenger-holding frame in synchronism with changes in said image, in a manner that generates resulting physical forces on occupants of said frame simulating at least some of the forces that would be applied to them in actual motion of the frame of the type depicted by said image, said image means being constructed to move with said passenger-holding frame;

said frame having a front portion nearest said screen means, a rear portion opposite said front portion, a pair of opposite sides, a centerline that lies halfway between said sides, and a vertical axis; and said drive means incuding three primarily vertical hydraulic rams, a first of said rams located at said front portion of said frame near said centerline, and a second and third of said rams being located at said rear portion of said frame on opposite sides of said centerline;

each of said rams being tilted away from the vertical in the same direction rlative to outwardly and inwardly of the frame so that the upper ends of the rams are each spaced a predetermined distance from the vertical axis of the frame which is different than the spacing of the lower ends of the rams, from said axis, whereby each ram provides a small horizontal force to the frame which is always in the same direction.

2. The apparatus described in claim 1 wherein: the lower end of each of said rams is closer to said vertical axis than is the upper end of the corresponding ram.

* * * * *